US005715569A

United States Patent [19]

Dickey

[11] Patent Number: 5,715,569

[45] Date of Patent: Feb. 10, 1998

[54] VACUUM CLEANER ACCESSORY FOR WATER HEATERS

[76] Inventor: Roy E. Dickey, 9344 Hopi Trail, Ooltewah, Tenn. 37363

[21] Appl. No.: 714,014

[22] Filed: Sep. 18, 1996

[51] Int. Cl.[6] ..... A47L 9/06

[52] U.S. Cl. ..... 15/415.1; 15/395; 15/401; 15/414

[58] Field of Search ..... 15/415.1, 393, 15/401, 414, 395, 398, 399, 400

[56] References Cited

U.S. PATENT DOCUMENTS

| | | | |
|---|---|---|---|
| 2,203,088 | 6/1940 | Hansson | 15/399 X |
| 2,206,959 | 7/1940 | Irish | 15/395 X |
| 2,241,771 | 5/1941 | Ell | 15/399 X |
| 3,971,098 | 7/1976 | Davis | 15/415.1 X |
| 4,053,962 | 10/1977 | McDowell | 15/395 X |
| 4,951,348 | 8/1990 | Krasznai et al. | 15/395 X |
| 4,976,004 | 12/1990 | Bufford-Thacker | 15/401 X |
| 5,046,218 | 9/1991 | Cerri . | |
| 5,054,160 | 10/1991 | Marino | 15/414 X |
| 5,410,776 | 5/1995 | Schneider | 15/415.1 X |

*Primary Examiner*—Chris K. Moore
*Attorney, Agent, or Firm*—Alan Ruderman

[57] ABSTRACT

An accessory for a vacuum cleaner for cleaning sediment from the floor of the inside of an electrical hot water tank is received within the electrical heating element mounting port of the tank and is configured such that it may be manipulated in a 360 degree traverse for cleaning the convex dome shaped floor including the floor adjacent the wall. The accessory has a first tubular member having one end adapted to be connected to the vacuum cleaner and includes four sections which have respective axes of elongation inclined relative to those of the adjacent sections. A second tubular member is received within the end of the first tubular member remote from the end which is attached to the vacuum cleaner and has a nozzle at its free end. The second tubular member may swivel about its axis relative to the first tubular member and may be extendible along its axis relative to the first tubular member. The nozzle has a free end which is inclined at an angle relative to the axis of the second tubular member for complementing the convex shape of the floor.

12 Claims, 1 Drawing Sheet

VACUUM CLEANER ACCESSORY FOR WATER HEATERS

BACKGROUND OF THE INVENTION

This invention relates to an accessory or attachment for vacuum cleaners and more particularly to an attachment or accessory for aiding in the cleaning of the bottom of hot water heaters using a vacuum cleaner.

Hot water heaters comprise a cylindrical tank into which water flows and is heated to a selected temperature by either an electrical heating element or a gas fired burner. The tanks generally include a convex bottom floor and may have a glass or ceramic coating to minimize corrosion and build up of sludge and mineral deposit or other sediment at the bottom of the tank and to prevent rust. In electrical hot water tanks the electrical heating element extends into the tank through a circular hole in the wall of the tank a few inches above the bottom floor. When the electrical heating element fails, it may be replaced by removal through the opening after the tank has been drained, and replaced by another element, such electrical elements being readily available. Because of the formation of sludge, mineral deposits and other sediment on the bottom of the water tanks, it is good practice to remove as much of these deposits as possible or the new electrical element will subsequently fail in a relatively short time. If, for example, mineral deposits or sediment reach the level of the heating element, the electrical element may short circuit and fail.

It is therefore recommended when replacing the electrical heating element that the sediment in the bottom of the water tank be removed. However, in the prior art, there is no known effective means for cleaning a substantial amount of the sediment out of the tank. The hole within which the electrical heating element is mounted provides the only entry into the tank for cleaning. However, because of its location, and because of the convex shape of the floor of the tank, a conventional vacuum cleaner wand or vacuum cleaner attachment does not permit access to the floor beneath the hole or 180 degrees opposite to the hole. Other portions of the periphery of the floor are also not readily accessible to thorough cleaning. Consequently, after replacement of the electrical heating element, the new heating element may have a relatively short life.

SUMMARY OF THE INVENTION

Consequently, it is a primary object of the present invention to provide an accessory for use with a vacuum cleaner for removing the sediment including sludge and mineral deposits on the bottom of an electrical hot water heater tank.

It is another object of the present invention to provide an accessory for attachment to the wand or hose of a canister type vacuum cleaner which has a configuration and structure permitting it to enter into the electrical heating element receiving hole in electrical hot water tanks and traverse substantially 360 degrees about the bottom of the tank.

It is a further object of the invention to provide an accessory comprising an elongated tube including a connecting end for connecting to the hose or a wand at the end of the hose of a vacuum cleaner, and a working end, the tube being bent at a discrete angle in at least two spaced apart locations intermediate the connecting and working ends so that the working end may enter into a hole above the floor in an electrically heated hot water tank and sweep about the periphery of the floor and also reach over the convex surface of the floor, the working end including a tubular member which may be rotated about its axis relative to the remainder of the accessory and carries a nozzle having a leading end surface adapted to complement the convex surface of the floor.

Accordingly, the present invention provides an accessory for connecting to the hose or wand of a vacuum cleaner for cleaning sediment from the floor of the inside of an electrical hot water tank, the accessory being received within the electrical heating element mounting port of the water tank and being capable of making a 360 degree traverse about the floor between the wall of the tank and the conventional convex dome shape of the floor. The accessory is a tubular structure having a mounting section with a first axis of elongation, a second section having a second axis of elongation inclined at a discrete angle relative to the first axis, a third section having a third axis of elongation inclined at another discrete angle relative to the second axis, and a fourth section. The fourth section has a fourth axis of elongation inclined relative to that of the third section so that the axis through the fourth section at the end remote from the third section is disposed substantially 90 degrees from the first axis. The fourth section carries a swivel member mounted for axial movement relative to the fourth axis, the swivel member carrying a nozzle having a free end or inlet inclined relative to the axis of the swivel member for substantially complementing the convex shape of the floor adjacent the walls of the water tank. By a discrete angle is meant that the change in direction is not subtle or curvalinear. The accessory may be inserted into the tank and manipulated about the floor and the nozzle may swivel selectively to receive all of the sediment.

BRIEF DESCRIPTION OF THE DRAWINGS

The particular features and advantages of the invention as well as other objects will become apparent from the following description taken in connection with the accompanying drawings in which.

DESCRIPTION OF THE PREFERRED EMBODIMENT

Figure 1:
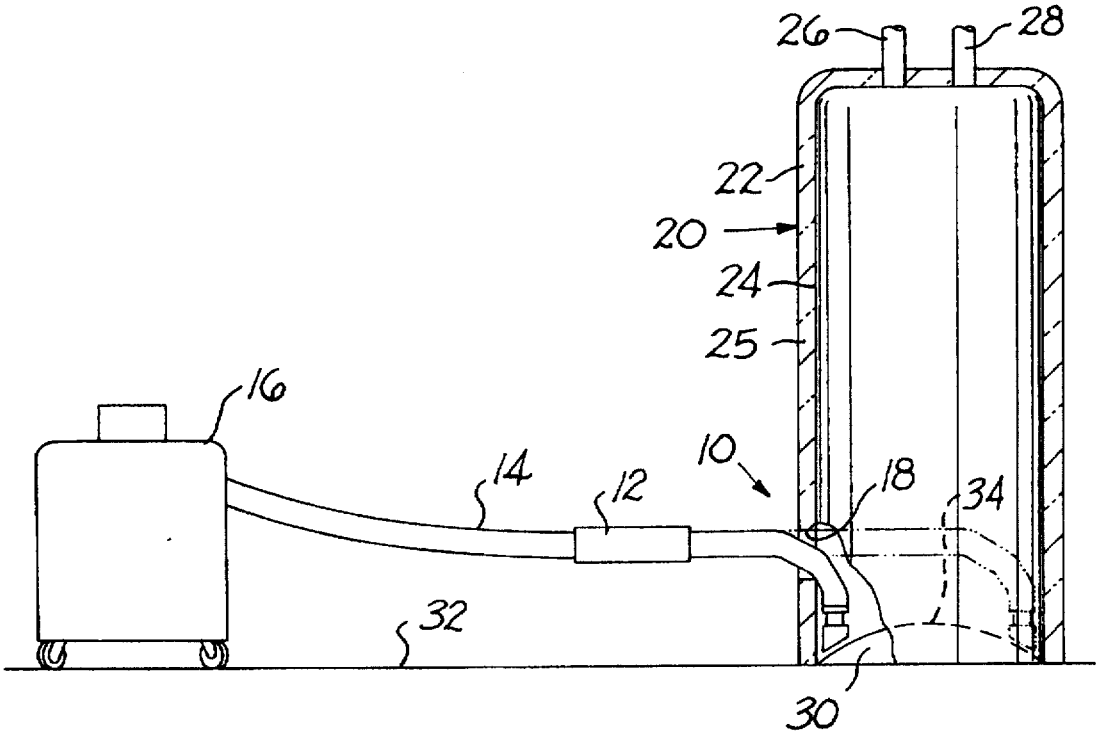
FIG. 1 is a diagrammatic view of an accessory constructed in accordance with the present invention in an operative mode connected to the wand of a vacuum cleaner for cleaning a hot water heater tank.

Referring now to the drawings, a vacuum cleaner accessory 10 according to the present invention may be connected to a coupling wand 12 on the hose 14 of a vacuum cleaner 16 which may be any type of canister vacuum cleaner, but preferably is a wet/dry vacuum cleaner. As illustrated in FIG. 1, the accessory 10 is receivable within a port 18 which is approximately 1¼ inches in diameter and normally receives the electrical heating element (not illustrated) of a conventional hot water tank 20 after the heating element has been removed. The tank 20 includes an outer shell 22 and an inner shell 24 separated by approximately 2 inches of insulation 25, the inner shell normally containing water which enters cold through a first pipe 26 and exits hot through a second pipe 28. Conventionally, the base 30 of the outer shell is disposed on the floor 32 of a building structure within which the heater is mounted while the inner shell 24 has a bottom 34 having a dome shape which is a convex configuration at the interior of the tank. Conventionally, the hot water tanks are cylindrical in configuration with the diameter of the inner tank ranging form 14 inches to 26 inches.

As aforesaid, sediment due to mineral deposits in the water or sludge builds up at the bottom 34 of the inner tank 24 over a period of time. Sediment in electrical water heaters may reach the level of the port 18 and cause the electrical heating element to short circuit and fail, or the electrical heating element may fail in time due to any number of factors. In any event, the element may be readily removed from the port 18 after the water has been drained from the tank, and replaced with another such heating element. However, unless the sediment is removed from the tank, failure of the new heating element will occur within a relatively short period of time.

In order to clean the bottom of the tank, the vacuum cleaner 16 conventionally is used in conjunction with a tool or accessory, or merely a curved wand. However, the wands or the prior art accessories do not permit a thorough cleaning of the bottom, partly due to the location of the port 18 relative to the floor adjacent the wall of the shell 24 and partly due to the dome configuration of the floor, the latter preventing manipulation of the prior art accessories or wands about the bottom of the tank.

Accordingly, the accessory 10 of the present invention comprises a first tubular member 36 preferably constructed from polyvinylchloride (PVC) plastic or the like having a first end 38 adapted for connection to the coupling wand 12 or the like so that it communicates with the hose 14 of the vacuum cleaner 16, and a second tubular member 40 received within the second end 42 of the tubular member 36. The diameter of the member 40 relative to the diameter of the member 36 at the end 42 is such that the member 40 may slidably move axially relative to the member 36 and may swivel relative thereto. In this regard a taper may be applied to the cooperating surfaces of one or both of the members 36, 40. The exterior surface at the end of the member 40 and the interior surface of the end 42 of the member 36 may have cooperating locking means such as respective rings or protuberances 44, 46 extending out of the surfaces so that the member 40 will not dislodge from the member 36. At the end of the member 40 externally of the member 36 there is a nozzle 48 which may be unitary with the member 40 and have a circular cross sectional configuration either of the same diameter as the member 40 or preferably larger as illustrated, but in no event is the diameter of the nozzle larger than the 1¼ inch diameter opening of the port 18. The free end 50 of the nozzle 48 is inclined relative to its axis of elongation 52 which is also the axis of elongation of the member 40. That is, the free end 50 lies in a plane at an angle to the axis 52, the angle being approximately 45 degrees so that the free end closely approximates the convex dome surface of the bottom 34 of the water tank.

The first tubular member 36 of the accessory 10 has an outside diameter of less than the 1¼ inch diameter of the port 18 in the tank 20, and in a prototype of the invention it has been found that a 1 inch diameter tubular member performed well. The first tubular member 36 comprises four sections. A first section 54 comprises a mounting portion 56 at the free end 38 for connecting to the wand 12 of the vacuum cleaner hose 14 and is elongated along a first axis 58. A second section 60 extends from the mounting section 54 along a second axis of elongation 62 which is inclined at a discrete angle relative to the axis 58. Preferably, the angle between these axes is approximately 30 degrees, but in any event less than 45 degrees. The length of the second section may be approximately 2½ inches as measured along the axis 62. Extending from the second section 60 is a third section 64 having a third axis of elongation 66 inclined at a discrete angle relative to the axis 62. Again, the angle between the axes 62 and 66 is approximately 30 degrees, but in any event less than 45 degrees, while the length of the third section may be approximately 1½ inches as measured along the axis 66. The third section terminates at a fourth section 68 which has the axis of elongation 52 inclined relative to the axis 66, the angle between the axes 66 and 52 either being a discrete angle or the axis 52 may be curved slightly, but in any event the end of the section 68 remote from the section 64 receives the second tubular member 40 and is approximately 90 degrees offset from the first axis of elongation 58.

Figure 2:
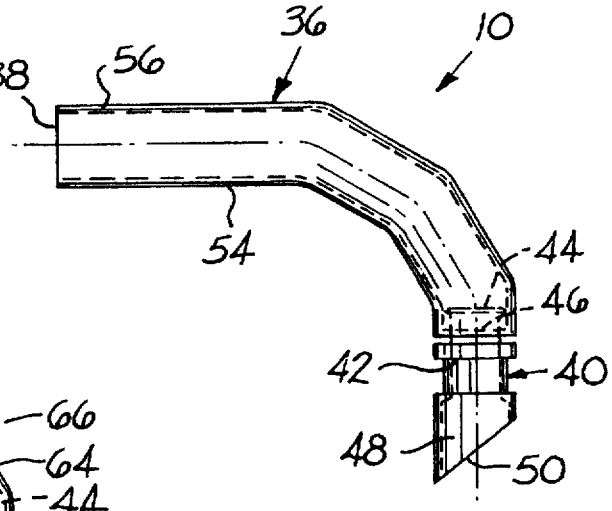
FIG. 2 is a side elevational view of the accessory with the nozzle disposed for cleaning the water heating tank at locations adjacent the entry port.
Figure 3:
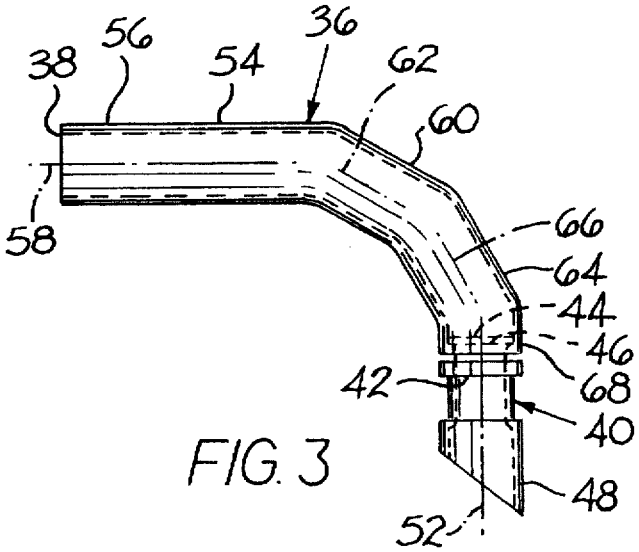
FIG. 3 is a view similar to FIG. 2 with the nozzle disposed for cleaning the tank and locations remote from the entry port.

The angular relationship and sizes of the second and third sections relative to the first section and the angular relationship of the fourth section and the second tubular member 40 relative to the second and third sections permits the accessory to be inserted into the interior of the water tank 20 through the port 18 and permits the nozzle 48 to be manipulated so that it may receive sediment from the bottom of the tank in the vicinity of the port 18 when the nozzle is in the position illustrated in FIG. 1 and 2, and also permits the accessory to be moved within the tank to manipulate the nozzle the entire 360 degrees about the bottom 34, the nozzle position being varied from the position illustrated in FIG. 2 to the position in FIG. 3 by swiveling the member 40 when the bottom 34 is to be cleaned at locations across from the port 18. Of course, the nozzle position may be varied between that illustrated in FIGS. 2 and 3 when cleaning the floor at locations intermediate the portal and opposite the portal. Thus, the entire floor 34 may be cleaned effectively before replacing the electrical heating element. The discrete angles made between the first and second sections and the second and third sections permit the required manipulation. It has been found that such manipulation could not occur if the entire accessory has an axis of elongation which is curved.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. An accessory for a vacuum cleaner for permitting the vacuum cleaner to clean a convex floor of an electrical hot water heater tank from which the heating element has been removed and water has been drained so that the accessory may be inserted through the heating element mounting port, said accessory comprising: a first tubular member having a first end for connecting in flow communication with the vacuum cleaner and a second end, a second tubular member having an axis of elongation and having a first end received within said second end of said first tubular member and a second end, a nozzle carried at the second end of said second tubular member, means for pivotally connecting one of said second tubular member and said nozzle for rotation about said axis of elongation relative to said first tubular member, said nozzle having an inlet end remote from said second tubular member disposed in a plane at an angle relative to said axis, said first tubular member having a plurality of sections, each section being inclined relative to adjacent sections, said first end of said first tubular member being defined as a free end of a first of said sections, and said first of said sections having an axis of elongation disposed approximately 90 degrees to the axis of elongation of said second member.

2. An accessory as recited in claim 1, wherein said first tube has four sections, a second of said sections extending from said first of said sections and having an axis of elongation inclined at a discrete angle relative to the axis of elongation of said first of said sections, a third of said sections extending from said second of said sections and having an axis of elongation inclined at a discrete angle relative to the axis of elongation of said second of sections, and a fourth of said sections extending from said third of said sections and having an axis of elongation inclined relative to the axis of elongation of said third of said sections, said fourth of said sections including said second end of said first tubular member.

3. An accessory as recited in claim 2, wherein the axis of elongation of said second of said sections is disposed at an angle of less than 45 degrees relative to the axis of elongation of said sections and to the axis of elongation of said third of said sections.

4. An accessory as recited in claim 3, wherein said second tubular member is pivotally mounted within said first tubular member and said nozzle is secured to said second tubular member.

5. An accessory as recited in claim 3, wherein said second tubular member is moveable axially along its axis of elongation relative to said first tubular member.

6. An accessory as recited in claim 5, wherein said second tubular member is pivotally mounted within said first tubular member and said nozzle is secured to said second tubular member.

7. An accessory as recited in claim 6, including means for precluding inadvertent removal of said second tubular member from said first tubular member.

8. An accessory as recited in claim 1, wherein said second tubular member is pivotally mounted within said first tubular member and said nozzle is secured to said second tubular member.

9. An accessory as recited in claim 8, wherein said first tube has four sections, a second of said sections extending from said first of said sections having an axis of elongation inclined at a discrete angle relative to the axis of elongation of said first of said sections, a third of said sections extending from said second of said sections and having an axis of elongated inclined at a discrete angle relative to the axis of elongation of said second of sections, and a fourth of said sections extending from said third of said sections and having an axis of elongation inclined relative to the axis of elongation of said third of said sections, said fourth of said sections including said second end of said first tubular member.

10. An accessory as recited in claim 1, wherein said second tubular member is moveable axially along its axis of elongation relative to said first tubular member.

11. An accessory as recited in claim 10, wherein said first tube has four sections, a second of said sections extending from said first said sections and having an axis of elongation inclined at a discrete angle relative to the axis of elongation of said first of said sections, a third of said sections extending from said second of said sections and having an axis of elongation inclined at a discrete angle relative to the axis of elongation of said second of sections, and a fourth of said sections extending from said third of said sections and having an axis of elongation inclined relative to the axis of elongation of said third of said sections, said fourth of said sections including said second end of said first tubular member.

12. An accessory as recited in claim 11, wherein said second tubular member is pivotally mounted within said first tubular member and said nozzle is secured to said second tubular member.

* * * * *